US006474637B1

(12) United States Patent
Spall et al.

(10) Patent No.: US 6,474,637 B1
(45) Date of Patent: Nov. 5, 2002

(54) ADAPTIVE FLAG WEIGHT FOR DOCUMENT HANDLING APPARATUS

(75) Inventors: J. Michael Spall, Plymouth, MI (US); Johan P. Bakker, Brighton, MI (US)

(73) Assignee: Unisys Corporation, Blue Bell, PA (US)

( * ) Notice: Subject to any disclaimer, the term of this patent is extended or adjusted under 35 U.S.C. 154(b) by 196 days.

(21) Appl. No.: 09/740,681

(22) Filed: Dec. 19, 2000

(51) Int. Cl.[7] ..... B65H 1/02

(52) U.S. Cl. ..... 271/160; 271/31.1; 271/129; 271/149

(58) Field of Search ..... 271/31.1, 129, 271/147–149, 160; 221/226–232, 279

(56) References Cited

U.S. PATENT DOCUMENTS

| | | | | |
|---|---|---|---|---|
| 3,035,834 A | | 5/1962 | Bottrell | 271/160 |
| 3,240,489 A | | 3/1966 | Pickney et al. | 271/160 |
| 3,598,399 A | | 8/1971 | Cottrell | 271/160 |
| 4,524,965 A | | 6/1985 | Kulpa | 271/160 |
| 4,685,648 A | * | 8/1987 | Dobner et al. | 248/123.11 |
| 4,953,748 A | | 9/1990 | Wheelock | 271/160 |
| 5,890,712 A | | 4/1999 | Phillips et al. | 271/160 |
| 6,419,221 B1 | * | 7/2002 | Spall | 271/31.1 |
| 6,434,851 B1 | * | 8/2002 | Nishina | 33/559 |

* cited by examiner

*Primary Examiner*—Christopher P. Ellis
*Assistant Examiner*—Mark A. Deuble
(74) *Attorney, Agent, or Firm*—Harness, Dickey & Pierce; Lisa A. Rode; Mark T. Starr

(57) ABSTRACT

An arrangement for adaptively driving the flag element of a document-handling device, such as a document sorter. The rotation of a first cam exerts a first force on the flag element. The profile of the first cam is such that the first force exerted on the flag element varies in accordance with the size of the document stack of the document-handling device. Alternatively, a second cam, rotatably connected to the first cam, causes a rotation of the first cam such that the first cam exerts a second force on the flag element. The first cam is shaped such that the second force exerted on the flag element is constant.

27 Claims, 3 Drawing Sheets

ADAPTIVE FLAG WEIGHT FOR DOCUMENT HANDLING APPARATUS

CROSS-REFERENCE TO RELATED APPLICATION

This application is related to U.S. patent application Ser. No. 09/521,162 (Spall), entitled "Adaptive Flag Weight for Document Handling Apparatus," filed Mar. 8, 2000, which is assigned to the assignee of the present application, and incorporated by reference in its entirety herein.

FIELD OF THE INVENTION

This invention relates generally to document handling devices, and more particularly, to an arrangement for adaptively driving a flag element of a document handling device.

BACKGROUND OF THE INVENTION

Document-handling devices are commonly used today to quickly move and sort a variety of documents, such documents generally consisting of one or more individual sheets. A feeding mechanism is used to introduce each sheet to the document transport for processing and sorting, and each sheet is often automatically fed from a document stack via this feeding mechanism. It will be appreciated that it is important to introduce each sheet individually, using consistent spacing between each sheet, in order to permit the fastest feed rate possible while still maintaining proper document processing.

In high-speed document sorters, a hopper is often used to locate and support a stack of sheets and supply them to the feeding mechanism, while a device, commonly known as a flag, is used to move the stack of sheets across the hopper during feeding. In order to create this movement, the flag must apply a force to the last sheet in the stack.

A number of systems are commonly known for applying this flag force. One such flag driving system is a non-variable dead weight system. This system uses potential energy derived from a constant weight that is attached to the flag by a cord or some other flexible connector. The constant weight creates a tension on the cord, and therefore, a force on the flag. The net result is a constant force transmitted from the flag onto the document stack.

A drawback of this non-variable dead weight system is that it is not possible to optimize the performance of the document-handling device. More specifically, it is improbable, if not impossible, to maintain proper document or sheet spacing through such arrangement. It will be appreciated that this results from the inability to variably control the force exerted by the flag on the document stack. For example, pushing a stack of several thousand sheets requires for more force than pushing the last few sheets. The constant uncontrollable nature of the force exerted on the document stack, will thus often result in wider spacing where there are many sheets, and closer spacing where there are fewer. This, in turn, results in poor document-handling device performance.

Another method of producing flag force against a document stack is to use some sort of motor arrangement with an associated electronic control system, to optimally control the flag force. To best adapt to flag force requirements, many motor driven flag systems often use sensors to measure and adjust the flag motion and force. However, because the mechanical environment created by a feed sorter can be turbulent, the sensors must undergo filtering to ensure that their sensed values are accurate. Thus, although these systems are generally more responsive to flag force requirements, they are generally complex, costly and subject to high maintenance.

In U.S. patent application Ser. No. 09/521,162 (Spall), an arrangement for driving the flag element of a document-handling device was disclosed, such arrangement including a constant weight 80 and cam 82 having variably increasing radii 84*a* and 84*b*, wherein 84*a* is a minimal radius and 84*b* is a maximum radius (FIG. 1). Although this arrangement was found to operate adequately under normal service conditions, even under cam motor 86 failure, certain anomalous conditions were found to render the device unserviceable. More specifically, it was found in those instances where interruption in power to cam motor 86, or failure of cam motor 86 itself, occurred while flag 88 was in the extreme left of the hopper 90, and thus cam 82 was rotated to its extreme clockwise position, attempted repair of the situation caused further problems. In this situation, the document-handling device operator might move the flag 88 to the right. In such instance, the constant weight 92 would be drawn upwards, the cam 82 would rotate counter-clockwise about shaft 94, and a portion of flag string 96 would be unwound from the cam 82. Should the operator then release flag 88, it will move back towards the left under the action of constant weight 80. However, since there is no driving torque on the cam 82, it will not move, and the extended portion of flag string 96 will not be drawn back in to wrap around cam 82, as would be the case were the cam motor 86 energized or otherwise operating correctly. As a result, the extended portion of the flag string 96 falls away from the cam 82, often necessitating a service intervention to replace the flag string 96 on the cam 82 in order to restore correct operation of the document-handling device.

It is therefore desirable to provide a document-handling apparatus with an improved mechanism that produces a flag force that is directly responsive to the force needed to move the document stack, and which is substantially immune to, or self-correcting of, anticipated operator repair attempts that might disable the previously disclosed system.

SUMMARY OF THE INVENTION

It is therefore an object of the present invention to provide an improved feeding mechanism for a document-handling device.

It is another object of the invention to provide a device n improved feeding mechanism that produces a flag force that is directly responsive to the force needed to move the document stack.

It is yet another object of the invention to provide an improved feeding mechanism for driving a flag element in a manner so as to present an adjustable force for moving a document stack.

A further object of the present invention is to provide an arrangement for adaptively driving the flag element of a document-handling device.

Accordingly, the present invention is directed to an arrangement for adaptively driving a flag element against a document stack of a document-handling device. In a preferred embodiment of the present invention, a first cam is connected to a flag element, and is rotationally mounted on the shaft of a motor that provides a constant torque. The rotation of the first cam exerts a first force on the flag element. The first cam is shaped such that the first force exerted on the flag element varies in accordance with the number of sheets in the document stack of the document-handling device. In another embodiment of the present invention, a second cam is rotatably connected to the first cam, the second cam having a fixed weight acting upon it tangentially by means of a cord or similar flexible connection. The rotation of the second cam produces a second, additive torque upon the first cam and thus a second additive force upon the flag. The two cams are shaped, and mounted with an angular relationship such that the torque applied by the second cam (due to the constant weight), when transmitted through the first cam, results in a constant additive force upon the flag.

BRIEF DESCRIPTION OF THE DRAWINGS

Additional objects, features, and advantages of the present invention will become apparent from studying the following detailed description and claims when taken in conjunction with the accompanying drawings, in which:

DETAILED DESCRIPTION OF PREFERRED EMBODIMENTS OF THE INVENTION

Figure 1:
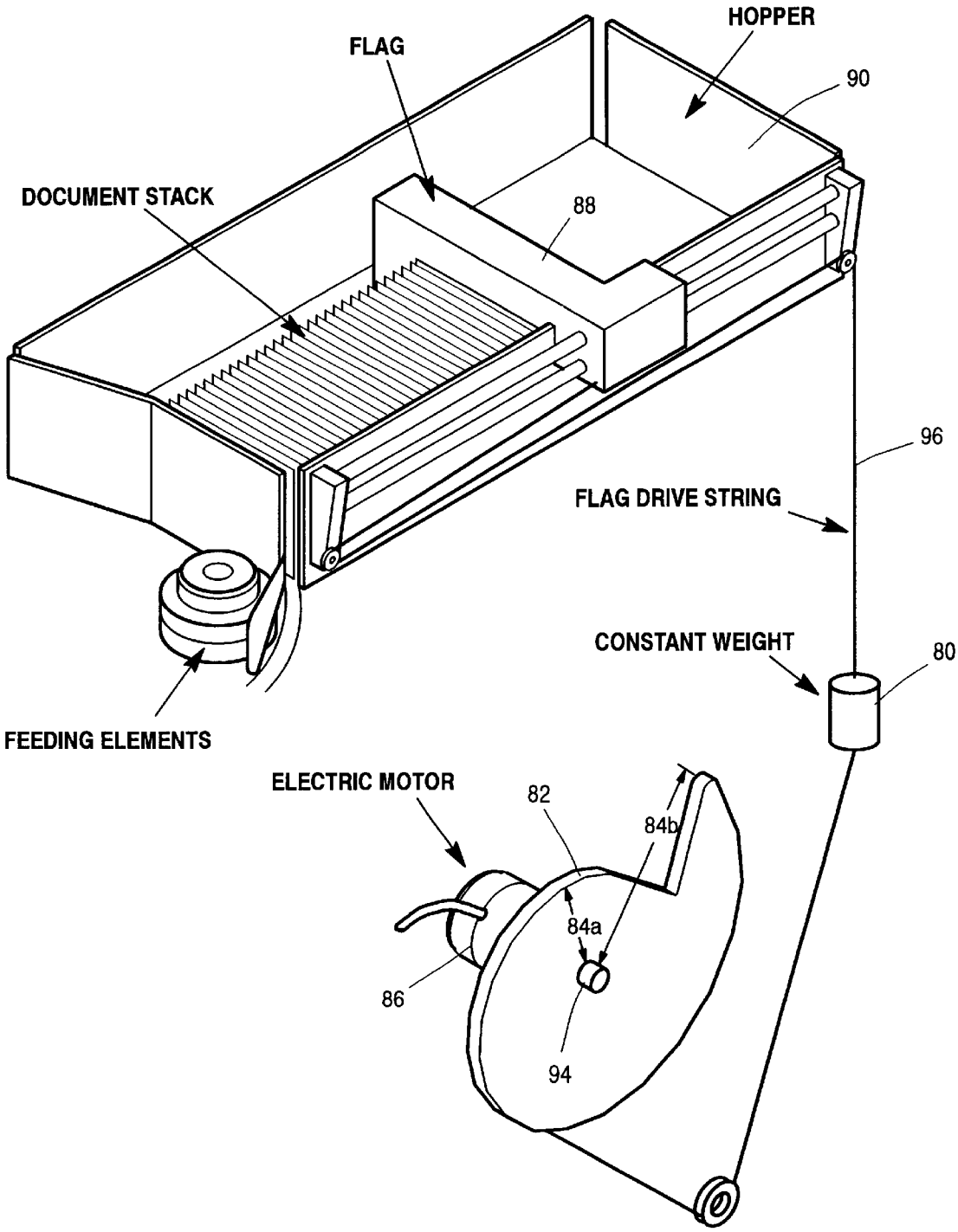
FIG. 1 is a perspective embodiment of an arrangement for driving the flag element of a document-handling device.

The following discussion and accompanying drawings are merely exemplary embodiments of the present invention and are for purposes of illustration only. One skilled in the art will readily recognize that the principles of the invention are well adapted for application to devices other than document-handling devices as well as to document-handling devices other than the one shown in the drawings. In fact, it is expected that the invention set forth herein will be applicable to any apparatus that requires that a force be adaptively applied to objects that need to be fed or otherwise moved along with continuous spacing. For example, the invention could be adapted to any mechanical, automated feeding system which requires a feeding force that is variable depending upon the number of items-to-be-fed contained in a stack, hopper or reservoir. Examples might include the feeding of blanks into presses, feeding of sheet stock into printing or copying machines, and the like.

Figure 2:
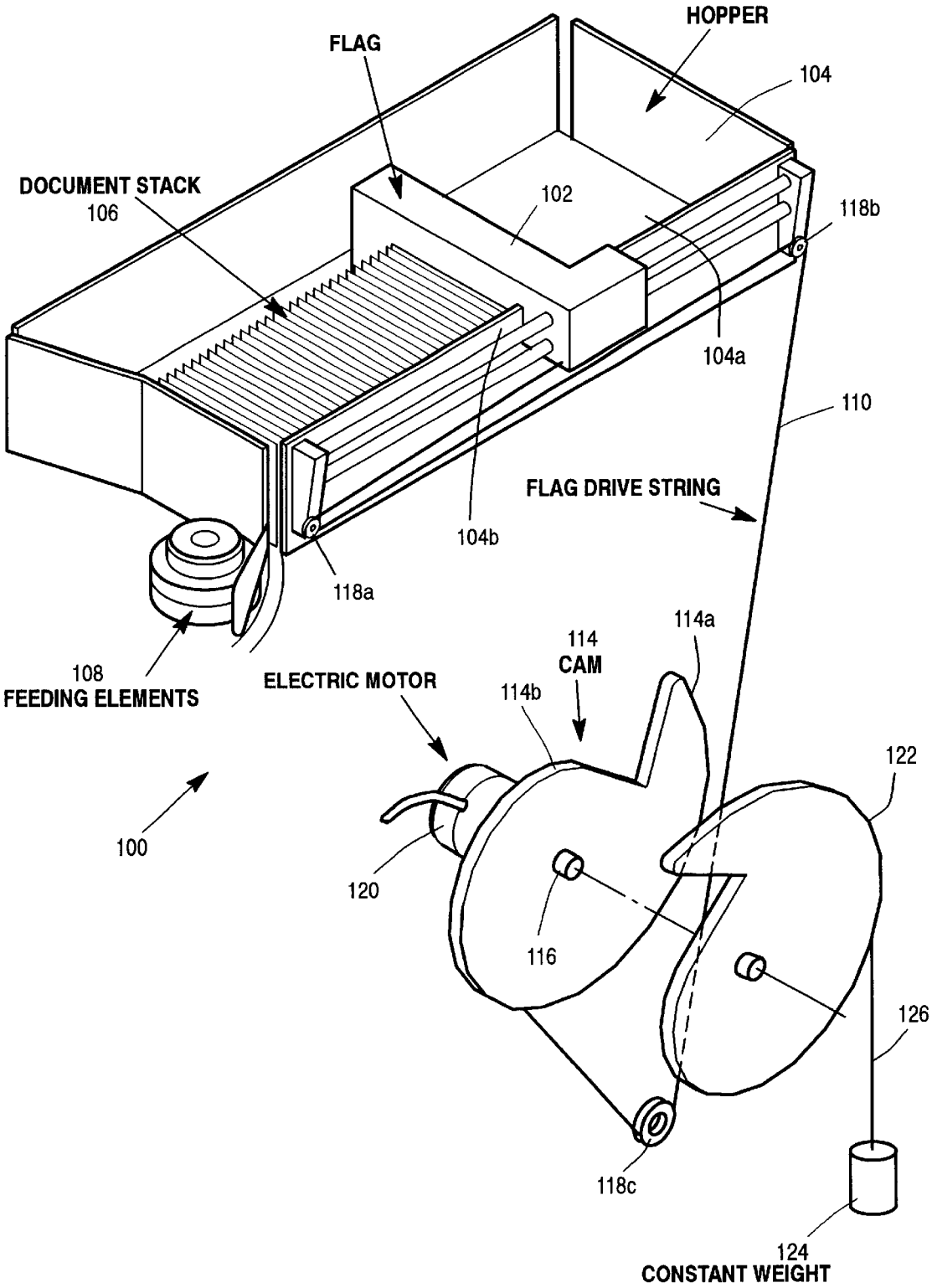
FIG. 2 is a perspective view of a preferred embodiment of an arrangement for adaptively driving the flag element of a document handling device according to the principles of the present invention; and, FIG. 3 is a side view of another preferred embodiment of an arrangement for adaptively driving the flag element of a document-handling device according to the principles of the present invention.

An embodiment of a document-handling apparatus according to the present invention is shown generally at 100 (FIG. 2). As seen therein, the document-handling apparatus 100 includes a hopper 104 that contains a document stack 106, which preferably comprises a number of individual sheets. The hopper 104 has a floor 104*a* and a leading edge guide wall 104*b* that serve to support the documents in the document stack 106. Leading edge guide wall 104*b* also provides support for a flag element 102. Flag element 102 abuts the document stack 106 and, during feeding, is used to move the document stack 106 across the hopper floor 104*a* toward feeding elements 108 to provide a necessary force to press the next sheet-to-be-fed against the feeding elements 108 of the document-handling apparatus 100. Feeding elements 108 include other mechanisms commonly known in the art, such as a nudger and feed wheel. Individual sheets are then removed from the hopper 104 by feeding elements 108 and are introduced into a document transport (not shown) for processing and sorting.

The flag element 102 is associated with a first cam 114 by a flag drive string 110, as seen in the preferred embodiment of FIG. 2, or by some other flexible connector, such as a cable or chain. The flag drive string attaches to the flag element 102 and is guided by pulley 118*a* and pulley 118*b*, which are attached along the leading edge guide wall 104*b*. An additional pulley 118*c* guides the flag drive string 110 to its attachment at first cam 114.

The first cam 114 is shaped such that its radius varies as a function of angular displacement. The radial dimensions are selected such that the ratio of minimum to maximum radius provides the desired force ratio, and so that the circumference of the resulting cam provides the desired travel. As depicted in FIG. 1, first cam 114 preferably has a first, minimum radial distance 114*b* and gradually increases to a second, maximum radial distance 114*a*. The first cam 114 is rotatively supported by shaft 116, which is connected at one distal end to a primary force generating mechanism, preferably an electric motor 120 as shown in FIG. 1, and which produces a constant torque on the first cam 114. The electric motor 120 is preferably connected to some suitable adjacent part (not shown) of the document-handling apparatus 100, although it will be appreciated that the present invention is not so limited, and since there is no operational limit on the length of flag drive string 110, the first cam 114 and electric motor 120 may be anchored elsewhere within the document-handling apparatus, or remote from it, as the particular embodiment may dictate. Although an electric motor 120 is preferably used, other known force generating mechanisms may be used to create a constant torque on the first cam 114, such as a dead weight suspended from a cable, a spring-motor, or a pneumatic or hydraulic actuator.

The first cam 114 is shaped such that the force of the flag element 102 produced by a constant motor torque varies to suit the relative size (i.e., the number of documents) of the document stack 106 in the hopper 104. For example, if a large number of documents are contained in the document stack, a large flag force is required; since the motor torque is constant, the radial length of the first cam 114 is small. As the number of documents in the document stack decreases, the force required in moving the document stack decreases. As the motor torque is constant, the radial length of the first cam 114 thus must increase (i.e., according to the principle $\tau = r \times F$, where $\tau$ is torque, r is radius and F is force)

In order to prevent the instances discussed previously wherein the flag string 110 becomes disengaged from the first cam 114, a constant weight must be arranged so that it applies a restoring torque to the first cam 114, even when the motor is disengaged or non-functioning (i.e., not applying torque). As the vari-radial profile of the first cam 114 causes a varying tension to the flag string 110 depending upon its radial position, the torque provided by this constant weight must also be varied, in direct proportion, in order to provide a constant, base tension to flag string 110, and thus a constant base force to flag element 102. In accordance with a preferred embodiment of the present invention, the adaptive drive arrangement further includes a second cam 122 and a secondary force-generating mechanism. The secondary force-generating mechanism and second cam 122 together produce a varying torque to first cam 114.

As shown in FIG. 2, the second cam 122 is also rotatably supported by shaft 116. The second cam 122 is substantially identical in dimension to, and coaxial with, the first cam 114. Preferably, the secondary force generating mechanism is a constant weight 124 that is attached to the second cam 122 by a weight string 126 or some other suitable flexible connector, such as a cable or chain. The weight string 126 wraps around the profile of the second cam 122. The first cam 114 and the second cam 122 are connected so as to rotate together, and are angularly positioned such that the radius of action of the first cam 114, acting on the flag drive string 110, and the radius of action of the second cam 122, acted on by the constant weight 124 through the weight string 126, are always equal through the total range of rotation of both cams.

During operation, electric motor 120 produces a constant torque, which is transferred to first cam 114 via shaft 116, thus causing first cam 114 to rotate. The rotation of the first cam 114, in turn, exerts a tension on the flag drive string 110 and subsequently on the flag element 102. Accordingly, the flag element 102 then exerts a force at the back end of the document stack 106. Concomitantly, the constant weight 124 exerts a downward force on the second cam 122, which produces a varying torque on the shaft 116, and thus also on the first cam 114. However, the variation in the torque provided to first cam 114 by constant weight 124 and second cam 122 is exactly cancelled due to the profile of first cam 114. Therefore, the constant weight has the effect of providing constant tension in the flag drive string 110, and thus flag element 102, regardless of the combined rotational position of the cams. If the power to the electric motor 120 is now interrupted, or the motor 120 otherwise fails, and flag element 102 is positioned towards the extreme left of hopper 104, constant weight 124 sill provide a restoring torque to the entire flag drive system. If the flag element 102 is then released from this position, constant weight 124 will act to restore the cams in a counter-clockwise direction, and any extended portion of the flag drive string 110 will remain under sufficient tension and thus prevent it from to prevent it from becoming displaced from first cam 114. Importantly, even if the flag element 102 is not at the extreme left of document hopper 104 when electric motor 120 fails or loses power, the constant weight 124 will still provide a constant, though not optimal, tension to the flag drive string 110. As such, although functioning at a downgraded performance level, the document-handling device will be operational until service can be scheduled, thus allowing for service schedule optimization.

Figure 3:
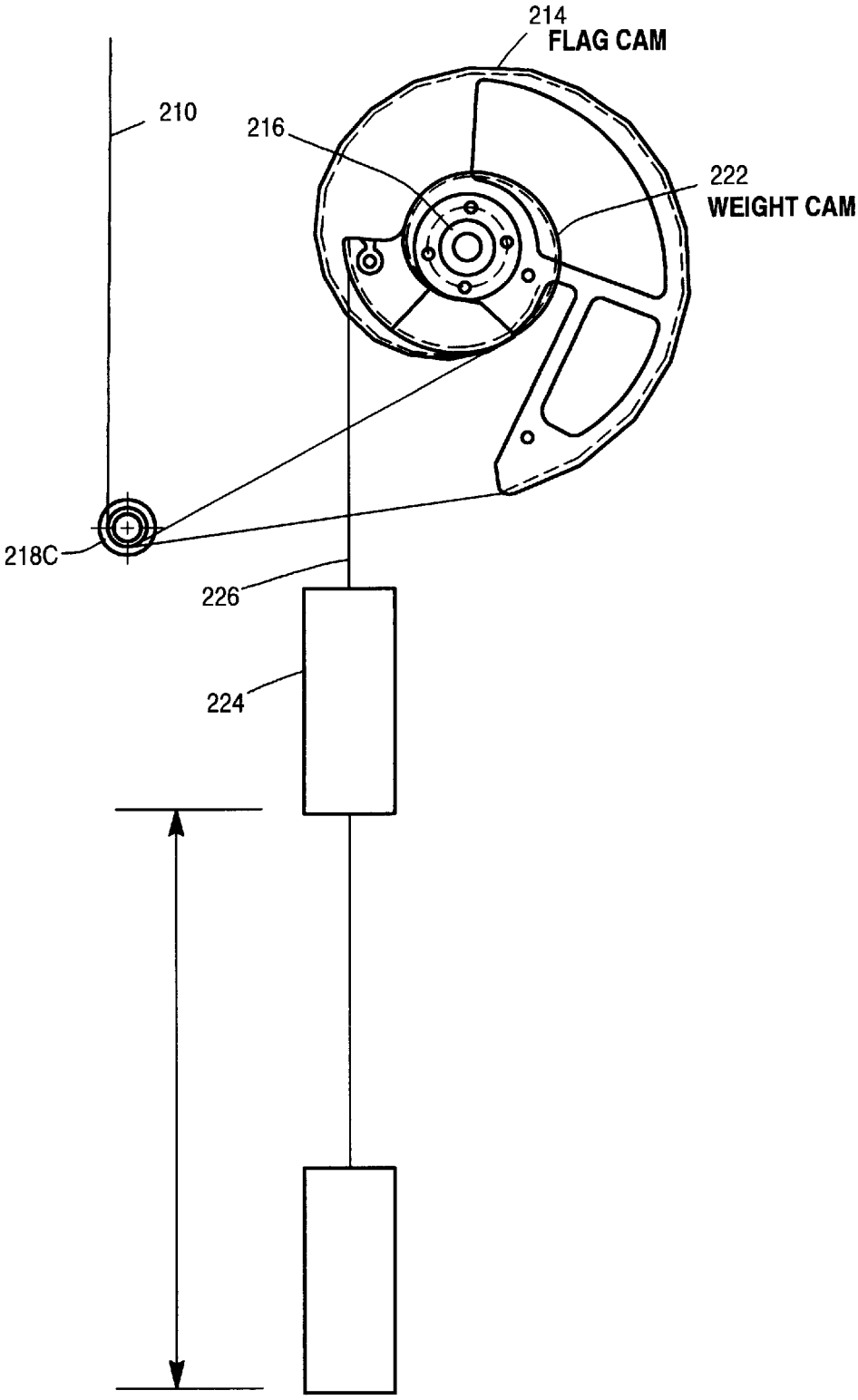

It will be appreciated that, the above embodiment might not be possible in those instances where there is not enough space for the movement of the weight 124 on the second cam 122. It will be appreciated that results similar to those shown above may be gained where a smaller second cam is used with a larger weight that travels less, or, alternatively a larger second cam with a smaller weight that travels more. The weight decrease/increase is inversely proportional to the peripheral length reduction of cam 122; e.g., double the weight for half the peripheral length. FIG. 3 illustrates such an alternate embodiment of the adaptive drive arrangement according to the principles of the present invention.

In such embodiment, second cam 222 and a secondary force generating mechanism have been modified relative to the embodiment depicted in FIG. 2. In particular, second cam 222 has a different peripheral length than that of the first cam 214, although it has a similar shape -i.e., gradually increasing from a first, minimum radial distance to a second, maximum radial distance. The force produced by the secondary force generating mechanism, which is preferably a constant weight 224 attached to the second cam 222 by a flexible connector 226, has been proportionally increased in order to reflect the change in the peripheral length of the second cam 222. The first cam 214 is shaped such that the variable torque provided by the constant weight 226 and second cam 222 translates into a constant tension on the flag drive string 210 and, therefore, a constant force on the flag element (not shown). It will be appreciated that this ability to so alter the peripheral length offers considerable advantages in packaging the mechanism in a machine.

Alternatively, it will be appreciated that the secondary force generating mechanism could be instead varied while the radial length of the second cam is held uniform. This secondary force generating mechanism could be a spring or elastic cord that is used in association with the uniform second cam. The arrangement could be designed to produce the appropriate variable torque that needs to be exerted on the first cam such that the constant force exerted on the flag element is obtained.

Because the second cam and constant weight arrangement can be varied in a number of ways, the arrangement can be varied according to the specific design of a particular document-handling device. Numerous benefits result from the constant force being applied to the flag drive string and flag element.

For example, the constant tension on the flag drive string ensures that the flag drive string maintains its operable position relative to the periphery of the first cam. This allows the flag drive string to restore itself to the periphery of the first cam regardless of an interruption in operation of the document-handling apparatus, such as a power-off event. In turn, this reduces the need for service intervention that would otherwise be required to restore the flag drive string to its operable position.

In addition, should the motor fail, the constant force exerted on the flag element produced by the second cam and secondary force generating mechanism arrangement could allow the document-handling device to continue to function at a reduced performance level.

Furthermore, as the arrangement of the present invention also allows the first cam to take advantage of the fixed relationship between the flag element position and the flag drive string position in order to match the flag element force needed to move the document stack, no costly control systems or expensive sensors are required. As a result, the embodiments of the present invention are expected to be economical to produce and to reduce system complexity. However, it is expected that if, for example, cost is not a determining factor, sensors could be added to the adaptive drive arrangement discussed herein to further optimize the performance of the document-handling device; e.g., by sensing the positional displacement of the flag element and selectively varying the torque of the motor element to apply a varying flag force as may be required by the particular conditions of a particular application.

Finally, if an electric motor is used with the first cam, additional adjustments can be made to increase the performance of the document-handling device. For example, the current supplied to the motor could be altered to accommodate document-handling devices of different speeds. Since document-handling devices use a variety of speed selections to perform simple, high volume document processing or complex, low volume document processing, the electric current could be adjusted to match the speed requirement of the particular document processing operation. In addition, since the feeding elements of document-handling devices are subject to wear, the motor could be adjusted to work in harmony with the performance of the worn feeding elements. Also, this constant force also could aid the motor to the effect of to reducing the requirements on the motor, thereby reducing wear and increasing its service life and/or permitting the use of a smaller or less costly motor.

The foregoing discussion and drawing discloses and describes merely an exemplary embodiment of the present invention. One skilled in the art will readily recognize from such discussion that various changes, modifications and variations may be made therein without departing from the scope of the invention as defined in the following claims.

What is claimed is:

1. A document-handling apparatus, comprising:

a hopper for supporting a document stack, including one or more individual sheets;

a flag element supported by said hopper for applying a force to said document stack;

a motor for producing a constant torque;

arrangement for adaptively driving said document stack, said arrangement including:

first drive means driven by said motor and connected to said flag element for applying a variable force on said flag element; and, second drive means rotatably connected to said first drive means for causing a rotation of said first drive means to exert a constant force on said flag element.

2. The document-handling apparatus of claim 1, wherein said first drive means includes:

an output shaft connected to said motor; and, a first cam connected to said flag element and mounted on said output shaft, wherein said constant torque causes a rotation of said first cam to cause said first cam to exert said variable force on said flag element, and wherein said first cam is shaped such that said variable force exerted on said flag element varies in accordance with said size of said document stack in said hopper.

3. The document-handling apparatus of claim 2, wherein said first cam has a vari-radial shape, said vari-radial shape increasing from a first minimal radius to a second maximum radial distance.

4. The document-handling apparatus of claim 2, wherein said second drive means includes:

a secondary force generating mechanism; and, a second cam mounted on said output shaft and coupled to said secondary force generating mechanism such that said secondary force generating mechanism and said second cam produce a varying torque, wherein said varying torque causes a rotation of said first cam to exert said constant force on said flag element.

5. The document-handling apparatus of claim 4, wherein said first and second cams are angularly positioned such that the radius of action of the first cam and the radius of action of the second cam are always equal through the total range of rotation of both cams.

6. The document-handling apparatus of claim 4, wherein said secondary force generating mechanism is a constant weight suspended from a connector coupled to said second cam.

7. The document-handling apparatus of claim 6, wherein said flexible connector is a flag drive string, a cable, or a chain.

8. The arrangement of claim 7, wherein said secondary force generating means includes a motor.

9. The document-handling apparatus of claim 4, wherein said flag element and said first cam are connected by a flexible connector.

10. An arrangement for adaptively driving a flag element against a document stock in a document-handling device comprising:

means for producing a constant torque;

a first cam connected to said flag element, and driven by said constant torque means to exert a variable force on said flag element, a secondary force generating means; and, a second cam and coupled to said secondary force generating mechanism, wherein said secondary force generating means and said second cam produce a varying torque, which causes rotation of said first cam to exert a constant force on said flag element.

11. The arrangement of claim 10, wherein said first cam is shaped such that said variable force exerted on said flag element varies in accordance with said size of said document stack of said document-handling device.

12. The arrangement of claim 11, wherein said first cam has a vari-radial shape, said vari-radial shape increasing from a first minimal radius to a second maximum radial distance.

13. The arrangement of claim 11, wherein said first and second cams are angularly positioned such that the radius of action of the first cam and the radius of action of the second cam are always equal through the total range of rotation of both cams.

14. The arrangement of claim 10, wherein said constant torque means includes:

a motor; and, an output shaft connected to said motor, wherein said first and second cams are mounted on said output shaft.

15. The arrangement of claim 10, wherein said secondary force generating mean is a constant weight suspended from a connector coupled to said second cam.

16. The arrangement of claim 10, wherein said secondary force generating means includes a spring.

17. An arrangement for adaptively driving a flag element against a document stack of a document-handling device comprising:

a first cam connected with said flag element, wherein rotation of said first cam exerts a first force on said flag element, said first cam having a vari-radial shape, said vari-radial shape increasing from a first minimal radius to a second maximum radial distance, such that said first force exerted on said flag element varies in accordance with said size of said document stack of said document-handling device; and, a second cam rotatably connected to said first cam, wherein rotation of said second cam produces a second torque, said second torque causing rotation of said first cam to exert a second force on said flag element, said first cam being shaped such that said second force exerted on said flag element is constant.

18. The arrangement of claim 17, wherein said first and second cams are angularly positioned such that the radius of action of the first cam and the radius of action of the second cam are always equal through the total range of rotation of both cams.

19. The arrangement of claim 17, wherein said flag element and said first cam are connected by a flexible connector.

20. The arrangement of claim 19, wherein said flexible connector is a flag drive string, a cable, or a chain.

21. The arrangement of claim 17, further comprising a primary force generating mechanism for causing said rotation of said first cam.

22. The arrangement of claim 21, wherein said primary force generating mechanism is a motor.

23. The arrangement of claim 21, wherein said second cam has a vari-radial shape, said vari-radial shape increasing from a first minimal radius to a second maximum radial distance.

24. The arrangement of claim 21, further comprising a secondary force generating mechanism for causing said rotation of said second cam.

25. The arrangement of claim 24, wherein said secondary force generating mechanism is a constant weight suspended from a connector or a spring.

26. The arrangement of claim 17, wherein said second cam has a uniform radius.

27. The arrangement of claim 26, wherein said secondary force generating mechanism is a spring or elastic cord.

* * * * *